US008152964B2

(12) United States Patent
Westerkamp et al.

(10) Patent No.: US 8,152,964 B2
(45) **Date of Patent: *Apr. 10, 2012**

(54) PRESS FABRIC FOR A MACHINE FOR THE PRODUCTION OF WEB MATERIAL

(75) Inventors: Arved Westerkamp, Dettingen/Erms (DE); Robert Eberhardt, Ellwangen (DE)

(73) Assignee: Voith Patent GmbH, Heidenheim (DE)

( * ) Notice: Subject to any disclaimer, the term of this patent is extended or adjusted under 35 U.S.C. 154(b) by 191 days.

This patent is subject to a terminal disclaimer.

(21) Appl. No.: 12/327,166

(22) Filed: Dec. 3, 2008

(65) Prior Publication Data

US 2009/0199988 A1 Aug. 13, 2009

(30) Foreign Application Priority Data

Dec. 21, 2007 (DE) ..... 10 2007 055 902

(51) Int. Cl.
*D21F 11/00* (2006.01)

(52) U.S. Cl. ..... 162/202

(58) Field of Classification Search ..... 162/358.2, 162/358.1, 900, 904; 442/268, 181, 199, 442/281, 275, 225

See application file for complete search history.

(56) References Cited

U.S. PATENT DOCUMENTS

| | | | | |
|---|---|---|---|---|
| 2,416,232 A | | 2/1947 | Soday | |
| 3,772,746 A | | 11/1973 | Ivanowicz | |
| 3,922,419 A | | 11/1975 | Hammer et al. | |
| 4,199,401 A | | 4/1980 | Liu et al. | |
| 4,267,227 A | | 5/1981 | Schiher et al. | |
| 4,357,386 A | | 11/1982 | Luciano et al. | |
| 4,439,481 A | | 3/1984 | Johnson et al. | |
| 4,446,187 A | | 5/1984 | Eklund | |
| 4,500,588 A | | 2/1985 | Lundstrom | |
| 4,529,643 A | * | 7/1985 | Lundstrom | 442/275 |
| 4,569,883 A | | 2/1986 | Renjilian | |
| 4,571,359 A | | 2/1986 | Dutt | |
| 4,772,504 A | | 9/1988 | Andresen | |
| 4,781,967 A | | 11/1988 | Legge et al. | |
| 4,847,116 A | | 7/1989 | Dutt | |
| 4,851,281 A | | 7/1989 | Wood | |
| 5,071,697 A | | 12/1991 | Gulya et al. | |
| 5,187,005 A | | 2/1993 | Stahle et al. | |
| 5,232,768 A | * | 8/1993 | Eklund et al. | 442/225 |
| 5,298,124 A | | 3/1994 | Eklund et al. | |

(Continued)

FOREIGN PATENT DOCUMENTS

DE 10 2006 055 827 A1 5/2008

(Continued)

OTHER PUBLICATIONS

International Search Report dated Sep. 24, 2004 of the International Searching Authority for PCT/ EP2004/050359 (3 pages).

(Continued)

*Primary Examiner* — Mark Halpern
(74) *Attorney, Agent, or Firm* — Taylor IP, P.C.

(57) ABSTRACT

The invention relates to a press fabric, especially a press felt, for a machine for the production of a fibrous web, especially paper or cardboard, which is fluid permeable and which includes an elastomer polymeric material. The invention is characterized in that the total weight component of the elastomer polymeric material contained in the press fabric is more than 50%, preferably more than 60% of the total weight of the press fabric.

29 Claims, 2 Drawing Sheets

U.S. PATENT DOCUMENTS

| | | | | |
|---|---|---|---|---|
| 5,346,516 | A | 9/1994 | Alkhas et al. | |
| 5,346,932 | A | 9/1994 | Takahashi et al. | |
| 5,508,094 | A | 4/1996 | McCarthy et al. | |
| 5,549,967 | A | 8/1996 | Gstrein | |
| 5,585,161 | A | 12/1996 | Difloe et al. | |
| 5,637,375 | A | 6/1997 | Hohman | |
| 5,732,749 | A | 3/1998 | Fargeout | |
| 5,783,501 | A | 7/1998 | Schuetze et al. | |
| 5,789,052 | A | 8/1998 | Miller et al. | |
| 5,925,221 | A | 7/1999 | Sayers et al. | |
| 5,971,897 | A | 10/1999 | Olson et al. | |
| 6,017,583 | A | 1/2000 | Gass | |
| 6,027,615 | A | 2/2000 | Davenport et al. | |
| 6,036,819 | A | 3/2000 | Miller et al. | |
| 6,337,112 | B1 | 1/2002 | Watanabe et al. | |
| 6,455,448 | B1 | 9/2002 | Davenport et al. | |
| 6,531,033 | B1 | 3/2003 | Kawashima | |
| 6,648,147 | B1 | 11/2003 | Lydon et al. | |
| 6,712,940 | B2 * | 3/2004 | Crook | 162/306 |
| 7,135,096 | B2 * | 11/2006 | Despault et al. | 162/358.2 |
| 7,259,117 | B2 | 8/2007 | Mater et al. | |
| 7,297,233 | B2 | 11/2007 | Herman et al. | |
| 7,306,703 | B2 | 12/2007 | Hawes | |
| 7,306,704 | B2 | 12/2007 | Hyvonen | |
| 7,351,307 | B2 | 4/2008 | Scherb et al. | |
| 7,638,018 | B2 | 12/2009 | Westerkamp et al. | |
| 7,670,461 | B2 | 3/2010 | Westerkamp | |
| 7,871,672 | B2 | 1/2011 | Crook et al. | |
| 7,981,820 | B2 | 7/2011 | Westerkamp et al. | |
| 8,034,730 | B2 | 10/2011 | Westerkamp et al. | |
| 2004/0016473 | A1 | 1/2004 | Hansen | |
| 2004/0126569 | A1 | 7/2004 | Davenport et al. | |
| 2004/0126601 | A1 | 7/2004 | Kramer et al. | |
| 2004/0237210 | A1 | 12/2004 | Thoroe-Scherb et al. | |
| 2005/0124248 | A1 | 6/2005 | Hyvonen | |
| 2005/0181694 | A1 | 8/2005 | Crook et al. | |
| 2006/0016545 | A1 * | 1/2006 | Hansen | 156/148 |
| 2006/0130992 | A1 | 6/2006 | Ouchi et al. | |
| 2007/0003760 | A1 | 1/2007 | Crook et al. | |
| 2007/0015804 | A1 | 1/2007 | Bauer et al. | |
| 2007/0026751 | A1 | 2/2007 | Westerkamp | |
| 2007/0277951 | A1 | 12/2007 | Westerkamp | |
| 2008/0248279 | A1 | 10/2008 | Patel et al. | |
| 2009/0163104 | A1 | 6/2009 | Westerkamp et al. | |
| 2009/0169804 | A1 | 7/2009 | Westerkamp et al. | |
| 2009/0186544 | A1 | 7/2009 | Westerkamp et al. | |
| 2009/0186546 | A1 | 7/2009 | Westerkamp et al. | |
| 2009/0199988 | A1 | 8/2009 | Westerkamp et al. | |
| 2010/0155008 | A1 | 6/2010 | Ragvald et al. | |
| 2010/0159760 | A1 | 6/2010 | Westerkamp et al. | |

FOREIGN PATENT DOCUMENTS

| | | | |
|---|---|---|---|
| DE | 10 2007 019 960 | A1 | 11/2008 |
| DE | 10 2007 000 578 | A1 | 4/2009 |
| DE | 10 2007 055 687 | A1 | 6/2009 |
| DE | 10 2007 055 690 | A1 | 6/2009 |
| EP | 0285376 | A2 | 10/1988 |
| EP | 0 653 512 | A2 | 5/1995 |
| EP | 0987366 | A2 | 3/2000 |
| EP | 0 987 366 | A3 | 4/2000 |
| EP | 1 127 976 | A2 | 8/2001 |
| EP | 1 757 728 | A1 | 2/2007 |
| GB | 2 102 731 | A | 2/1983 |
| GB | 2 200 687 | A | 8/1988 |
| WO | 99/41447 | A1 | 8/1999 |
| WO | 03/076046 | A2 | 9/2003 |
| WO | 03/091498 | A1 | 11/2003 |
| WO | 20041085727 | A2 | 10/2004 |
| WO | 2005/075733 | A1 | 8/2005 |
| WO | 20081122461 | A1 | 10/2008 |
| WO | 2008/131984 | A1 | 11/2008 |

OTHER PUBLICATIONS

English translation of International Preliminary Report on Patentability dated Oct. 1, 2005 for PCT/EP2004/050359 (6 pages).

English translation of Written Opinion (showing dated received of Sep. 23, 2004) of the International Searching Authority for PCT/EP2004/050359 (5 pages).

Office Action dated Apr. 14, 2010 of European Patent Office for Application No. 04 741 439.6-2314 (3 pages).

German patent application serial No. 10 2007 055 690.1; filed Dec. 3, 2007; entitled: Lightweight Membrane With Glass Bubbles.

German patent application serial No. 10 2007 0550 687.1; filed Dec. 3, 2007; entitled: Lightweight TPE-V Membrane.

German patent application serial No. 10 2007 000 578.6; filed Oct. 26, 2007; entitled: Lightweight Membrane Layer.

Communication dated Jan. 22, 2010 from European Patent Office for Application No. EP08161408 (1 page).

Communication dated Apr. 14, 2009 from European Patent Office including European Search Report (dated Apr. 2, 2009) and European Search Opinion for Application No. EP 08161408 (7 pages).

Communication dated Jan. 22, 2010 from European Patent Office for Application No. EP08161409 (1 page).

Communication dated Apr. 14, 2009 from European Patent Office including European Search Report (dated Apr. 2, 2009) and European Search Opinion for Application No. EP 08161409 (6 pages).

Communication dated Jan. 22, 2010 from European Patent Office for Application No. EP08161410 (1 page).

Communication dated Apr. 14, 2009 from European Patent Office including European Search Report (dated Apr. 2, 2009) and European Search Opinion for Application No. EP 08161410 (6 pages).

Communication dated Jan. 22, 2010 from European Patent Office for Application No. EP08161414 (1 page).

Communication dated Apr. 14, 2009 from European Patent Office including European Search Report (dated Apr. 2, 2009) and European Search Opinion for Application No. EP 08161414 (6 pages).

Communication dated Jan. 22, 2010 from European Patent Office for Application No. EP08166853 (1 page).

Communication dated Apr. 29, 2009 from European Patent Office including European Search Report (dated Apr. 15, 2009) and European Search Opinion for Application No. EP 08166853 (7 pages).

Communication dated Jul. 7, 2011 from European Patent Office for European Application No. EP 08 161 414 (3 pages).

* cited by examiner

PRESS FABRIC FOR A MACHINE FOR THE PRODUCTION OF WEB MATERIAL

BACKGROUND OF THE INVENTION

1. Field of the Invention

The current invention relates to a fabric for a machine for the production of web material, especially paper or cardboard, as well as a machine for the production and/or converting of a fibrous web.

2. Description of the Related Art

The continuous press fabrics utilized, for example, in press sections in paper machines move together with the web material which is to be manufactured through one or several press nips where, for example, by way of two rolls pressing together, the press fabric and the web material which is to be produced and which runs between them is being compressed on the one hand, and liquid is squeezed from it on the other hand. The squeezed out liquid is to be removed by, or through, the press fabric. For this to occur it is necessary to provide this press fabric with a permeable structure, or a structure with hollow spaces, suitable for absorption of the liquid. A structure of this type, however, obviously is also subject to press loads occurring in the area of a press nip. Therefore there is the danger of material fatigue due to the constant compression and relaxation, or that the permeability and therefore the available hollow spaces could be greatly reduced over the duration of the operation.

Especially with the modern and future press concepts where instead of the previously employed three or more press nips only two or one press nip are utilized, clearly greater press pressures than previously occur in order to achieve higher dry contents of the web. The greater press pressures result in a clearly greater material fatigue on the utilized press felts than have previously been known.

What is needed in the art is a press fabric for a machine for the production of web material, especially paper or cardboard, and a machine for the production of a fibrous web with which improved liquid removal properties and a greater stability under load can be achieved and with which a lasting constant dewatering capacity is achieved.

SUMMARY OF THE INVENTION

The present invention provides, according to a first aspect of the current invention, a press fabric for a machine for the production of web material, especially paper or cardboard which is fluid permeable and which includes an elastomer polymeric material whose total weight component is more than 50%, preferably more than 60%, of the total weight of the press fabric.

In other words, the invention provides that the total weight of the elastomer polymeric material contained in the press fabric represents a share of more than 50%, preferably more than 60%, of the total weight of the press fabric.

Due to the high weight share of elastomer polymeric material in the press fabric, a press fabric having a high wear resistance, lasting hollow space volume and great buffering capacity is provided.

The inventive press fabric preferably includes a carrying structure and at least one layer of fibrous material, whereby fibers of the one or several layers of fibrous material are embedded at least partially into the elastomer polymeric material and the carrying structure.

Due to the very high weight share of elastomer polymeric material in the press fabric, combined with the fact that the fibers of the fibrous layer and/or the carrying structure are at least partially embedded in the elastomer polymeric material, a press fabric having an even longer lasting constant hollow space volume is provided in this variation. In addition, a very high vibration absorption is achieved due to the very high weight component of elastomer polymeric material which is firmly bonded with fibers of the at least one fibrous layer and/or with the carrying structure. Furthermore, due to the very high weight component of elastomer polymeric material in the press fabric, the machine-side wear and tear and the paper-side fiber loss can clearly be reduced since, on the one hand, the elastomer polymeric material bonds the fibers of the fibrous layer which contains said polymeric material considerably better and, on the other hand, the polymeric material can provide a wear volume.

In order to be able to make a targeted adjustment of the characteristics of the inventive press fabric, a preferred embodiment of the invention provides that the weight share of the polymeric material relative to the total weight of the press fabric varies locally in the direction of the thickness.

Alternatively, the share of the weight of the polymeric material relative to the total weight of the press fabric can be locally constant in the direction of thickness.

A plurality of variations is conceivable regarding the properties of the elastomer polymeric material.

It is conceivable for example that the elastomer polymeric material includes a first elastomer polymeric material which coats fibers of the at least one layer at least partially with a film.

The first elastomer polymeric material may for example include an elastomer polyurethane. Specifically, the first polymeric material is an elastomer polyurethane.

The first polymeric material can be applied for example in the form of an aqueous dispersion of particle shaped, especially fine particle shaped first polymeric material into the at least one layer of fibrous material. Subsequently liquid is removed from the dispersion added into the fibrous layer, causing the film which coats the fibers to form from the polymeric material. This means that the film coating the fibers of the at least one fibrous layer is formed essentially, especially completely in that liquid is removed from the particulate polymeric dispersion (from the additional polymeric material) and in that the polymeric particles adhere to the fibers in the form of a film. Such aqueous dispersions are known for example, under the name "witcobond polymer dispersion" and are marketed for example by Baxenden Chemicals Ltd., England.

At least part of the fibers of the at least one layer of fibrous material may be coated with several film layers of first polymeric materials. It is conceivable in this context that at least some of the several film layers have different characteristics when compared to each other. These different characteristics can for example result from comparatively different first polymeric materials which are used for the respective film layers.

If the first polymeric material is applied from the direction of the web material contact surface the first polymeric material which coats the fibers of the at least one fibrous layer can extend to a depth of 10% to 100%, preferably to a depth of 30% to 100%, more especially preferably to a depth of 50% to 100%, relative to the overall thickness of the press fabric. Desirable bonding of the various layers of fibrous material with each other and with the carrying structure can be achieved by complete penetration of the press fabric with the first polymeric material.

Alternatively, or in addition the elastomer polymeric material may include a second elastomer polymeric material which forms a permeable composite structure with fibers of the at least one fibrous layer in that the polymeric material only partially fills and/or bridges hollow spaces formed between fibers in this layer.

The layer of fibrous material which contains the second polymeric material may for example be the layer of fibrous material providing the web material contact surface.

The second polymeric material is furnished preferably in the form of particles in preferably an aqueous dispersion into the at least one layer of fibrous material and is subsequently melted. In this variation the permeable composite structure which contains the second polymeric material is created in that that the second polymeric material is melted following its addition into the at least one layer of fibrous material, adheres to the fibers and in that the melted polymeric material subsequently again solidifies, adhering to the fibers.

Here, liquid can be removed, for example drawn from the at least one layer of fibrous material, preferably prior to melting of the particle shaped second polymeric material.

The second elastomer polymeric material forms preferably a single-component and permeable polymeric layer.

Hereby a single-component and permeable polymeric layer is created which extends in the layer of fibrous material and which is embedded at least partially into the layer of fibrous material. The polymeric layer is firmly bonded with the fibers, whereby said fibers are at least partially embedded into said polymeric layer.

A single component polymeric layer is to be understood to be a polymeric layer which is formed from a single continuous component. In order to provide permeability, openings extend though the polymeric layer, whereby the openings in the polymeric layer are formed in that the polymeric material which forms the polymeric layer fills and/or bridges the hollow spaces between the fibers of the fibrous layer only partially. To verify that the permeable polymeric layer is indeed a single component, the fibrous material—if it is of example polyamide—can be leached out for example with formic acid.

The polymeric layer is in fact fluid permeable, however the polymeric material forming said polymeric layer is preferably actually fluid impermeable. The permeability of the polymeric layer in the sense of the current design form is created in that the polymeric material only partially fills and/or bridges hollow spaces which are formed between fibers in the layer of fibrous material.

The single component and fluid permeable polymeric layer forms a permeable composite structure with fibers in the fibrous layer which provides a large water drainage capacity and which does not compress much during operation. Due to the fact that the polymeric material forms a single component polymeric layer, the polymeric material clearly separates from the layer of fibrous material less easily when under the influence of shear forces or high pressure water jets, than is the case with polymeric material which only forms a multitude of disconnected polymeric agglomerates in the fibrous material.

The single component polymeric layer preferably extends over the entire length and over the entire width of the layer of fibrous material. In this scenario the polymeric layer therefore forms an independent layer within the layer of fibrous material. This provides a press fabric which possesses constant characteristics across its width, for example dewatering capacity, rebound capacity, etc.

Alternatively it may be useful for the purpose of a targeted local manipulation of the characteristics of the inventive press fabric if the polymeric layer extends along the entire length and only across part of the width of the layer of fibrous material. In this context it is conceivable, for example, to provide a polymeric layer in the area of the respective longitudinal edge in the layer of fibrous material which respectively only extends over a section of the width of the fibrous material layer. It is also conceivable that the polymeric layer extends only in the central area of the fibrous material layer and that no polymeric layer is located in the area of the two longitudinal edges of the fibrous material layer.

The polymeric layer is preferably elastically compressible. Here the polymeric layer may have a hardness in the range of 50 to 97 Shore A.

The second polymeric material is preferably an elastomer polyurethane, especially a thermoplastic elastomer polyurethane.

It is significant for a plurality of applications if the polymeric layer has a thickness in the range of approx. 0.05 mm to approx. 1.5 mm, preferably approx. 0.05 mm to approx. 1.0 mm.

In addition it is possible that the polymeric layer extends over the entire thickness of the fibrous material layer or alternatively, that the polymeric layer extends only over a part of the thickness of the fibrous material layer.

A preferred variation of the invention provides that the first as well as the second elastomer polymeric material are provided in at least one of the layers of fibrous material.

In this embodiment the effects generated by the two polymeric materials conspire together. The fibers, or at least part of them, are coated with the additional film-forming polymeric material and are thereby structurally supported and strengthened. This coating may already create a cross-linkage between the individual fibers so that a clearly better rebound characteristic can be combined with reduced material fatigue when considering the elastic characteristics of the polymeric material provided for the coating. Because of the continuing presence of the polymeric material which forms a permeable composite structure with the layer of fibrous material and which especially bridges and/or fills hollow spaces between the fibers of the at least one fibrous layer, the water absorption and water removal characteristic of this layer can be purposefully adjusted.

To this end the second polymeric material forming the polymeric layer is preferably at least partially, especially completely adhered to sections of the fibers which are already coated with the first polymeric material which forms the film.

In this scenario the first polymeric material which forms the film acts as bonding agent between the second polymeric material and the fibers of the at least one fibrous layer, thereby clearly improving the bond of the second polymeric material to the fibers of the fibrous layer.

The following process may be utilized to apply the two polymeric materials. First, the fibers are coated with the first polymeric material provided for this purpose, for example through the application of a film-forming polymeric dispersion and subsequent drying or removal of the liquid medium. The application of the preferably particle shaped second polymeric material occurs only thereafter. If the process is controlled so that the second polymeric materials adhere to locations on the fibers which are already coated with a film from the first polymeric material, a bonding of the second polymeric material with the fibers which are already coated with a polymeric film occurs following a drying and melting process, thereby creating a permeable, highly elastic composite structure for the transportation of the web through the machine which forms the web.

Alternatively, it is obviously also feasible to apply the first and the second polymeric material simultaneously.

Another advancement of the invention provides that the at least one layer of fibrous material which contains the first and the second polymeric material is compressed by utilizing pressure and/or temperature, after the two polymeric materials were applied. This achieves a pre-compacting and/or smoothing of this layer.

Preferably at least some of the fibers of the at least one fibrous layer are bonded with each other at fiber cross points and/or fiber contact points through the first polymeric material that forms the film. Through bonding of the fibers in the layer a connected mesh structure consisting of interconnected fibers is created. This mesh structure contributes considerably and positively to the elasticity characteristics and the rebound capacity of the at least one layer of fibrous material.

Preferably the first polymeric material with which the fibers are coated has a higher melting point than the second polymeric fabric which forms the specifically single-component and permeable polymeric layer. This allows the second polymeric material to be added after the fibers were already coated with the film of the first polymeric material, without the film which coats the fibers being impaired by the heating necessary for melting of the base material for the second polymeric material.

The film consisting of the first polymeric material which coats at least sections of the fibers has preferably a thickness in the range of 1 μm to 20 μm.

It is conceivable that the first polymeric material and the second polymeric material have different elastic properties when compared with each other.

The first polymeric material in particle form can especially be of a smaller particle size than the second polymeric material in particle form.

Size of a particle is to be understood generally as being its maximum spatial dimension in one direction, in other words length or width or height.

For example, at least 50% of the particles of this fine particulate first polymeric material are of a size in the range of 2.0 nm to 10 μm. In this context it is also conceivable that all particles of the fine particulate additional polymeric material are of a size of 10 μm maximum, especially of 2 μm maximum.

Good results in the application capacity of the second polymeric material are achieved if 50 volume % of the total volume of all particles of the second polymeric material (average value d50) have a particle size between 20 μm and 150 μm, preferably between 50 μm and 100 μm.

Particularly in order to provide a mark-free web material contact surface it may be useful if the layer which provides the web material contact surface of the press fabric contains at least the second polymeric material, whereby the second polymeric material is located preferably in the area of the web material contact surface, so that the permeable composite structure provides the web material contact surface.

If the second polymeric material forms a single component and permeable polymeric layer, then said layer extends in the area of the web material contact surface and provides large local surface elements, thereby producing clearly lower local pressure differentials upon the web material contact surface when the inventive press fabric runs through a press nip than would be the case if a non-coated fibrous layer were to provide the web material contact surface. This has an especially positive effect upon a uniform and mark free dewatering of the web in the press nip.

In order to affect specifically only the web material contact surface of the press fabric, without affecting its volume area it is useful if the second polymeric material—beginning from the web material contact surface—extends to a depth of 10% to 50%, preferably to a depth of 10% to 30%, more especially to a depth of 10% to 20% relative to the entire thickness of the press fabric. Hereby essentially only the web material surface is affected by the second polymeric material.

It is however also conceivable that the layer of fibrous material which provides the machine contact surface of the press fabric contains the first and/or second polymeric material.

To positively influence long-term stable water absorption capacity it can also be significant if the fibrous material layer containing the second polymeric material is located between a fibrous material layer which provides the web material contact surface and the carrying structure.

An additional variation of the invention provides that either only the first elastomer polymeric material or only the second elastomer material is provided in at least one of the layers of fibrous material.

An advancement of the invention further provides that one of the layers of fibrous material which is located between the layer of fibrous material which provides the web material contact surface and the carrying structure contains at least the first polymeric material. A layer of fibrous material containing at least the first polymeric material can specifically be a layer which is located between a layer of fibrous material which provides the web material contact surface and the carrying structure.

The carrying structure may be woven or randomly laid. It is conceivable in this context that the carrying structure includes a single component polymeric screen structure or is in the embodiment of same, as described for example in EP0285376. Generally, any flat textile structure is conceivable that would be able to function as a load-bearing carrying structure.

In addition, the at least one layer of fibrous material is preferably in the embodiment of a non-woven layer. Specifically, all layers of fibrous material in the press fabric are non-woven layers.

Alternatively, or in addition to the aforementioned structures, the inventive press fabric may include at least one layer of fibrous material, especially a non-woven layer whose fibers are composed at least partially, especially completely of thermoplastic polyurethane. A structure of this type is described, for example in the German patent application 10 2007 000 578.6. The disclosure of the application 10 2007 000 578.6 is herewith incorporated into the current application.

In addition, the press fabric may alternatively, or in addition to the aforementioned structures include at least one non-textile layer, for example a cast or a converted membrane or mesh structure, which includes one or several vulcanized thermoplastic elastomers, or consists of same. A structure of this type is described, for example in the German patent application 10 2007 055 687.1. The disclosure of the application 10 2007 055 687.1 is herewith incorporated into the current application.

In addition, alternatively or in addition, a non-textile mesh structure is conceivable which includes thermoplastic polyurethane as matrix material with globular glass material embedded in it, or which is constructed of same. A structure of this type is described, for example in the German patent application 10 2007 055 690.1. The disclosure of the application 10 2007 055 690.1 is herewith incorporated into the current application.

Furthermore, a structure is conceivable alternatively, or in addition, whereby a substrate consisting of a plurality of threads and which is provided in the form of a two-dimensional formation is coated with at least two layers of coating medium, whereby at least two of the layers of the coating material have different characteristics compared to each other. At least one of the layers can be composed from an elastomer polymeric material. A structure of this type is described, for example in the German patent application 10 2006 055 827.8. The disclosure of the application 10 2006 055 827.8 is herewith incorporated into the current application.

The press fabric can have a thickness of 4 mm or less, preferably 3.5 mm or less, especially preferably 2.8 mm or less. Because of the modest thickness of the press fabric, the nip geography is influenced only very slightly as the press fabric runs through the press nip.

According to a second aspect of the current invention, the present invention provides a machine for the production and/or conversion of a fibrous web, especially a paper, cardboard or tissue web, including a press section in which the fibrous web is dewatered and whereby the press section includes a maximum of two press nips and whereby the material web is dewatered in at least one of the two press nips by way of at least one fluid-permeable press fabric which contains elastomer polymeric material whose total weight component is more than 50%, preferably more than 60% relative to the total weight of the press fabric.

In this case the press fabric includes especially a carrying structure and at least one layer of fibrous material, whereby the elastomer polymeric material embeds fibers of the one or several layers of fibrous material and/or the carrying structure at least partially.

New press concepts with a maximum of two press nips are to be realized especially on future high speed paper machines. No known press felt structure is capable of absorbing the large volume of water which occurs in each press nips of a press section which is equipped with only two press nips. Therefore, a greater part of the water must be removed from the press nip, without being absorbed by the press felt itself. This is only possible if the press felt in the press nip does not compact greatly over the duration of the operational life in order to guarantee a constant dewatering characteristic over the operational life. The inventive solution, in other words the utilization of a press felt having an elastic polymeric component of more than 50 weight % of the total weight of the press felt in a press section which is equipped with a maximum of two press nips, makes this possible.

Preferably, the press section is equipped with only one single press nip, so that the entire dewatering is achieved through only one press impulse. The one single press nip can be provided in the form of a shoe press.

According to an additional especially preferred variation of the invention at least one, preferably both covers of the press nips are equipped with a grooving extending in machine direction. In combination with the inventive press fabric this clearly improves dewatering.

The previously described advantages come to bear especially in the case of high speed machines. Therefore, an especially preferred variation provides that the machine runs with a web speed of 1600 m/min. or faster, preferably 1800 m/min. or faster, especially preferably 2000 m/min.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
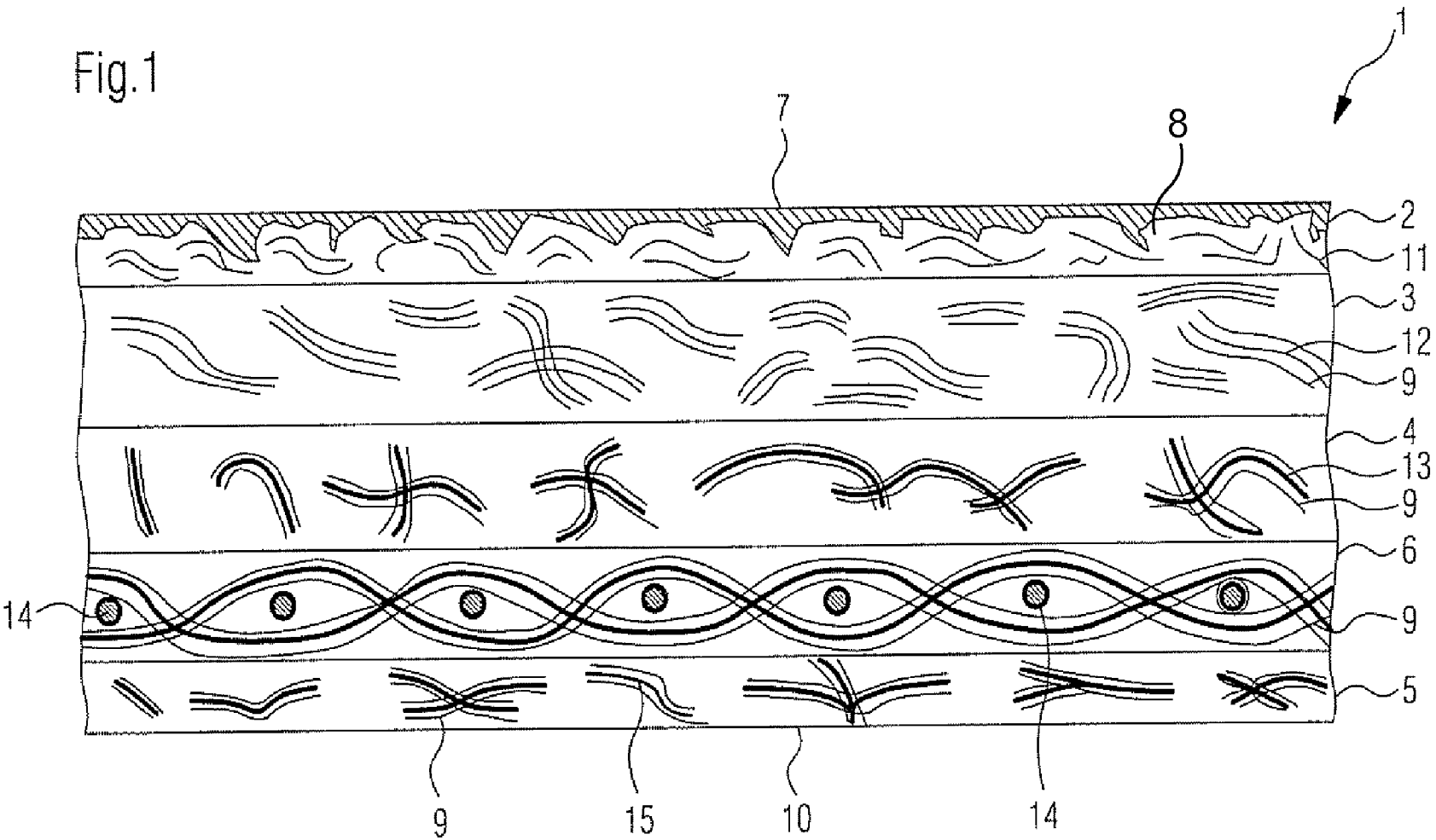
FIG. 1 is a cross section of an inventive press fabric 1, in the embodiment of a press felt.

Referring now to the drawings, and more particularly to FIG. 1, there is shown the press fabric 1 which consists of several layers of fibrous material in the embodiment of nonwoven layers 2-5, as well as a carrying structure 6 in the form of a woven structure.

According to the invention the press fabric also includes an elastomer polymeric material whose total weight component in the press fabric is more than 50%, preferably more than 60%, relative to the total weight of the press fabric.

The elastomer polymeric material at issue includes only a first and a second polymeric material. The first as well as the second elastomer polymeric material are an elastomer polyurethane.

The top layer 2 of the nonwoven layers provides the web material contact surface 7 of the press fabric 1 and includes fibers 11 having a titer in the range of approx. 3.3 to 6.7 dtex. The fibers are formed predominantly of PA. The second elastomer polymeric material into which fibers of the nonwoven layer 2 are embedded, at least partially, is contained in the uppermost nonwoven layer 2, in the area of the web material contact surface 7. The second elastomer polymeric material, together with fibers of the uppermost nonwoven layer 2, hereby forms a permeable composite structure in that the second polymeric material partially fills and/or bridges hollow spaces between fibers of this layer 2. In the present example the second elastomer polymeric material forms a single-component and permeable polymeric layer 8 which is located in the uppermost nonwoven layer 2. The polymeric layer 8 has a thickness in the range of approx. 0.05 mm to approx 1.5 mm, preferably approx 0.05 mm to approx. 1.0 mm. The second polymeric material has a weight ratio of 1:1 relative to the nonwoven layer 2.

Accordingly it can be stated that the nonwoven layer 2 which provides the web material contact surface 7 of the press fabric 1, contains at least the second polymeric material.

Two intermediate nonwoven layers 3, 4 are located between the nonwoven layer 2 which provides the web material contact surface 7, and the carrying structure 6.

The upper intermediate nonwoven layer 3 includes fibers 12 with a titer in the range of approx. 17 dtex. The fibers are formed predominantly of PA. The first elastomer polymeric material into which fibers of the nonwoven layer 3 are completely embedded is contained in the upper center nonwoven layer 3. The first elastomer polymeric material forms a film 9 which coats the fibers of the nonwoven layer 3, at least partially. The first polymeric material has a weight ratio of 1:2 relative to the nonwoven layer 3.

The lower center nonwoven layer 4 includes fibers 13 with a titer in the range of approx. 44 dtex. The fibers are formed predominantly of PA. The first elastomer polymeric material into which fibers of the nonwoven layer 4 are completely embedded is contained in the lower center nonwoven layer 4. The first elastomer polymeric material forms a film 9 which coats the fibers of the nonwoven layer 4, at least partially. The first polymeric material has a weight ratio of 1:2 relative to the nonwoven layer 4.

Accordingly it can be stated that the nonwoven layers 3, 4, which are located between the nonwoven layer 2 which provides the web material contact surface 7 and the carrying structure 6, contains at least the first polymeric material.

In addition it can be said that nonwoven layers 3, 4, which are located between the nonwoven layer 2 which provides the web material contact surface 7 and the carrying structure 6, have a greater titer than the nonwoven layer 2 which provides the web material contact surface 7.

The lowest of the nonwoven layers 5 provides the machine contact surface 10 of the press fabric 1 and includes fibers 15 with a titer in the range of approx. 44 dtex. The fibers are formed predominantly of PA The first elastomer polymeric material into which fibers of the nonwoven layer 5 are completely embedded is contained in the lowest nonwoven layer 5. The first elastomer polymeric material forms a film 9 which coats the fibers of the nonwoven layer 5 at least partially. The first polymeric material has a weight ratio of 1:1.5 relative to the nonwoven layer 5.

Also, in the nonwoven layers 3-5 the first polymeric material extends over the entire thickness of the respective nonwoven layer, whereas the polymeric layer 8 extends only over a portion of the thickness of the uppermost nonwoven layer 2.

The first polymeric material which at least partially coats the threads 14 of the carrying structure 6 with a film 9 is also contained in the carrying structure 6.

Accordingly, in the current design example the nonwoven layers contain either only the first elastomer polymeric material or only the second elastomer polymeric material. Furthermore, the weight component of the polymeric material relative to the total weight of the press fabric varies locally in thickness direction of the press fabric 1.

Also, the first and the second polymeric material are in fact fluid-impermeable.

Figure 2:
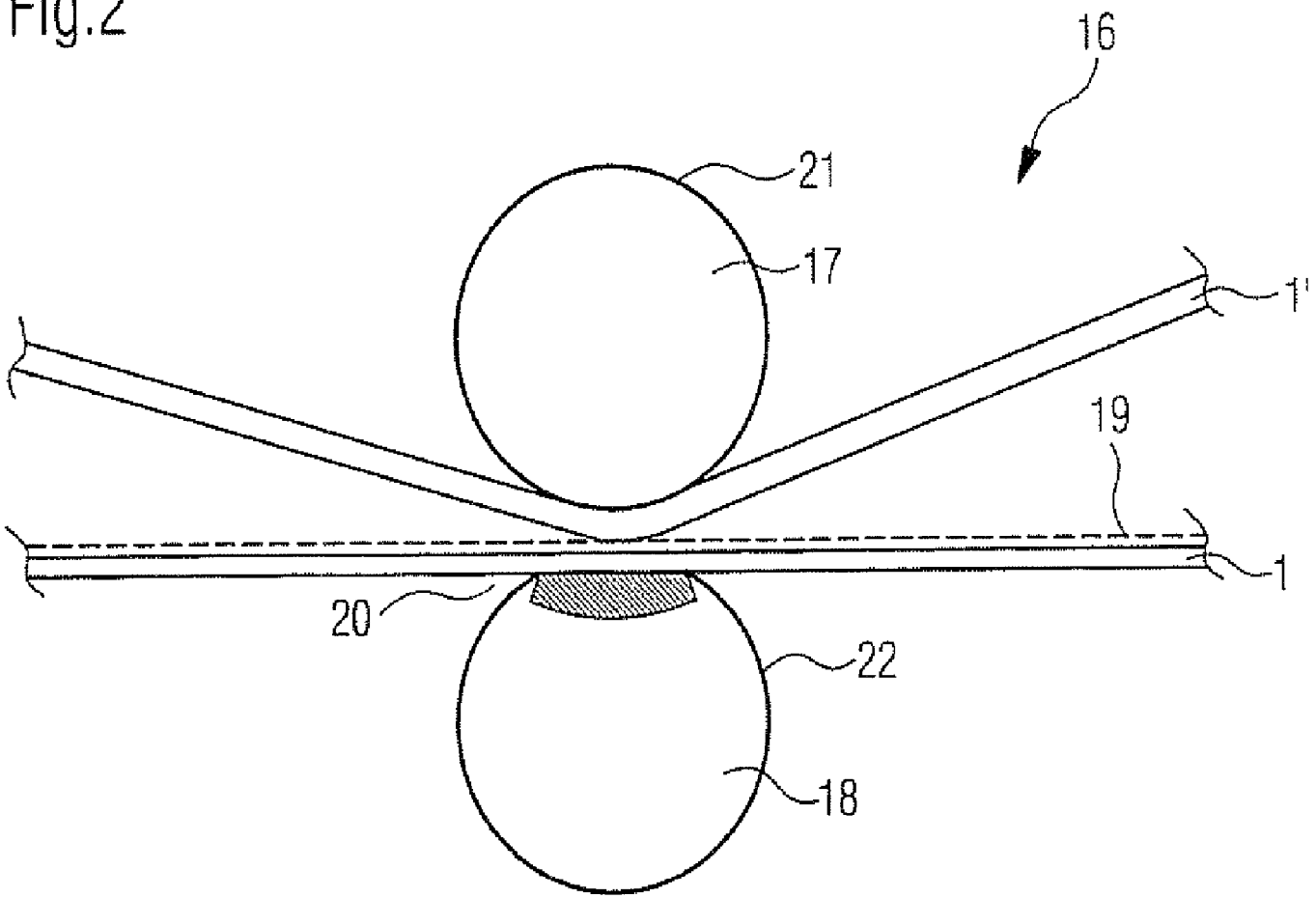
FIG. 2 is an inventive machine, equipped with press felts according to FIG. 1.

FIG. 2 illustrates an inventive machine for the production and/or conversion of a fibrous web, especially a paper, cardboard or tissue web, including a press section 16 with only one single press nip 20 in which a web 19 is dewatered. The machine illustrated in FIG. 2 is designed to run at a web speed of 1600 m/min. or faster, preferably 1800 m/min. or faster, especially preferably 2000 m/min.

The web 19 is run through the press nip 20, sandwiched between two press felts 1, 1' which are shown in FIG. 1, and is dewatered by these.

In this example the press nip 20 is formed by a shoe press which is equipped with an upper conventional press roller 17 and a lower press roller which is in the embodiment of a shoe press roller 18.

Each cover 21, 22 on the two press rollers 17, 18 is provided with grooving extending in machine direction (MD).

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press fabric for a machine for a production of a web of fibrous material, said press fabric comprising:

an elastomer polymeric material, the press fabric being fluid permeable, a total weight component of said elastomer polymeric material included in the press fabric being more than 50% of a total weight of the press fabric, a weight share of said elastomer polymeric material relative to said total weight of the press fabric varying locally in a direction of a thickness of the press fabric.

2. The press fabric according to claim 1, wherein said total weight component of said elastomer polymeric material included in the press fabric is more than 60% of a total weight of the press fabric.

3. The press fabric according to claim 1, further including a carrying structure and at least one layer of fibrous material including a plurality of fibers, said plurality of fibers of said at least one layer of fibrous material being embedded at least partially into said elastomer polymeric material and said carrying structure.

4. The press fabric according to claim 1, further including at least one layer of fibrous material including a plurality of fibers, wherein said elastomer polymeric material includes a second elastomer polymeric material which forms a permeable composite structure with at least some of said plurality of fibers in that said second elastomer polymeric material only partially at least one of fills and bridges a plurality of hollow spaces formed between said plurality of fibers.

5. A press fabric for a machine for a production of a web of fibrous material, said press fabric comprising:

an elastomer polymeric material, the press fabric being fluid permeable, a total weight component of said elastomer polymeric material included in the press fabric being more than 50% of a total weight of the press fabric;

at least one layer of fibrous material including a plurality of fibers, said elastomer polymeric material including a first elastomer polymeric material which coats at least some of said plurality of fibers at least partially with a film, said elastomer polymeric material including a second elastomer polymeric material which forms a permeable composite structure with at least some of said plurality of fibers in that said second elastomer polymeric material only partially at least one of fills and bridges a plurality of hollow spaces formed between said plurality of fibers.

6. The press fabric according to claim 5, wherein said second elastomer polymeric material forms a single-component and permeable polymeric layer.

7. The press fabric according to claim 6, wherein said single-component and permeable polymeric layer has a thickness in a range of approximately 0.05 mm to approximately 1.5 mm.

8. The press fabric according to claim 6, wherein said single-component and permeable polymeric layer has a thickness in a range of approximately 0.05 mm to approximately 1.0 mm.

9. The press fabric according to claim 5, wherein said at least one layer of fibrous material includes a plurality of layers of fibrous material, both said first elastomer polymeric material and said second elastomer polymeric material being provided in at least one of said plurality of layers of fibrous material.

10. The press fabric according to claim 5, wherein said at least one layer of fibrous material includes a plurality of layers of fibrous material, one of only said first elastomer polymeric material and only said second elastomer polymeric material being provided in at least one of said plurality of layers of fibrous material.

11. The press fabric according to claim 5, wherein the press fabric has a total thickness of at most 4 mm.

12. The press fabric according to claim 5, wherein the press fabric has a total thickness of at most 3.5 mm.

13. The press fabric according to claim 5, wherein the press fabric has a total thickness of at most 2.8 mm.

14. The press fabric according to claim 5, wherein said at least one layer of fibrous material includes a plurality of layers of fibrous material, wherein one layer of said plurality of layers of fibrous material includes a web material contact surface of the press fabric and contains at least said second elastomer polymeric material.

15. The press fabric according to claim 14, wherein said second elastomer polymeric material, beginning from said web material contact surface, extends to a depth of 10% to 50% relative to an entire thickness of the press fabric.

16. The press fabric according to claim 14, wherein said second elastomer polymeric material, beginning from said web material contact surface, extends to a depth of 10% to 30% relative to an entire thickness of the press fabric.

17. The press fabric according to claim 14, further including a carrying structure, wherein another layer of said plurality of layers of fibrous material is located between said layer of fibrous material including said web material contact surface and said carrying structure and contains at least said first elastomer polymeric material.

18. The press fabric according to claim 5, wherein said first elastomer polymeric material is an elastomer polyurethane, and said second elastomer polymeric material is an elastomer polyurethane.

19. The press fabric according to claim 5, wherein one layer of said plurality of layers of fibrous material provides a machine contact surface and contains at least one of said first elastomer polymeric material and said second elastomer polymeric material.

20. The press fabric according to claim 5, wherein said second elastomer polymeric material is at least partially adhered to at least a plurality of sections of said at least some of said plurality of fibers which are already coated with said first elastomer polymeric material which forms said film.

21. The press fabric according to claim 5, wherein said second elastomer polymeric material is completely adhered to at least a plurality of sections of said at least some of said plurality of fibers which are already coated with said first elastomer polymeric material which forms said film.

22. The press fabric according to claim 5, wherein said film which coats at least a plurality of sections of said at least some of said plurality of fibers which are at least partially coated with said film has a thickness in a range of 1 μm to 20 μm.

23. The press fabric according to claim 5, wherein at least some of said plurality of fibers are bonded with each other at least one of at a plurality of fiber cross points and at a plurality of fiber contact points through said first elastomer polymeric material that forms said film.

24. The press fabric according to claim 5, wherein at least part of said at least some of said plurality of fibers which are coated at least partially with said film are coated with a plurality of film layers of said first elastomer polymeric material.

25. The press fabric according to claim 24, wherein said plurality of film layers have different characteristics when compared with each other.

26. The press fabric according to claim 5, wherein the press fabric includes a web material contact surface, and wherein, starting at said web material contact surface, said first elastomer polymeric material which coats said at least some of said plurality of fibers extends to a depth of 10% to 100% relative to an overall thickness of the press fabric.

27. The press fabric according to claim 5, wherein the press fabric includes a web material contact surface, and wherein, starting from a direction of said web material contact surface, said first elastomer polymeric material which coats said at least some of said plurality of fibers extends to a depth of 30% to 100% relative to an overall thickness of the press fabric.

28. The press fabric according to claim 5, wherein the press fabric includes a web material contact surface, and wherein, starting from a direction of said web material contact surface, said first elastomer polymeric material which coats said at least some of said plurality of fibers extends to a depth of 50% to 100% relative to an overall thickness of the press fabric.

29. The press fabric according to claim 5, wherein said first elastomer polymeric material with which said at least some of said plurality of fibers are coated has a higher melting point than said second elastomer polymeric fabric which forms a polymeric layer about, and thereby said permeable composite structure with, said at least some of said plurality of fibers which are at least partially coated with said film.

* * * * *

UNITED STATES PATENT AND TRADEMARK OFFICE

CERTIFICATE OF CORRECTION

PATENT NO. : 8,152,964 B2
APPLICATION NO. : 12/327166
DATED : April 10, 2012
INVENTOR(S) : Arved Westerkamp et al.

It is certified that error appears in the above-identified patent and that said Letters Patent is hereby corrected as shown below:

TITLE PAGE

Page 2, Column 2 under FOREIGN PATENT DOCUMENTS, please delete "WO 20041085727 A2 10/2004", and substitute therefor --WO 2004/085727 A2 10/2004--; and Page 2, Column 2 under FOREIGN PATENT DOCUMENTS, please delete "WO 20081122461 A1 10/2008", and substitute therefor --WO 2008/1222461 A1 10/2008--.

Signed and Sealed this
Thirtieth Day of April, 2013

Teresa Stanek Rea
*Acting Director of the United States Patent and Trademark Office*